US005624065A

United States Patent [19]

Steffe

[11] Patent Number: 5,624,065

[45] Date of Patent: Apr. 29, 1997

[54] SAFETY SPORT BELT

[76] Inventor: Frank Steffe, 1025 Jassamine Way, Fort Lee, N.J. 07024

[21] Appl. No.: 574,074

[22] Filed: Dec. 18, 1995

[51] Int. Cl.[6] ..... F42B 39/02

[52] U.S. Cl. ..... 224/625; 224/600; 224/620; 224/623; 224/148.7; 2/312; 2/319; 2/338

[58] Field of Search ..... 224/600, 604, 224/620, 615, 623, 622, 625, 626, 637, 646, 647, 648, 652, 654, 658, 159, 160, 195, 196, 148.7, 148.2; 2/1, 312, 319, 338

[56] References Cited

U.S. PATENT DOCUMENTS

| | | | |
|---|---|---|---|
| 1,871,223 | 11/1930 | Reese | 224/648 |
| 3,089,143 | 5/1963 | Jacobson | 2/1 |
| 3,401,857 | 9/1968 | Wilson et al. | 224/637 |
| 3,931,917 | 1/1976 | Zellmer | 224/5 R |
| 4,534,619 | 8/1985 | Bedford | 2/338 |
| 5,060,835 | 10/1991 | Payne | 224/148.2 |
| 5,263,618 | 11/1993 | Talavera | 224/148.7 |
| 5,333,768 | 8/1994 | Krentz | 224/623 |
| 5,477,998 | 12/1995 | Reckler | 224/637 |

*Primary Examiner*—Henry J. Recla
*Assistant Examiner*—Kam Shah
*Attorney, Agent, or Firm*—Martin J. Spellman, Jr.

[57] ABSTRACT

A safety sport belt having a waist belt and at least one shoulder strap slidingly connected to the waist belt. The waist belt and the strap comprised of a polyester mesh fabric coated with reflective material. A transparent strip is centrally aligned on outer surface of the shoulder strap and the waist belt, which is stitched over a non-transparent strip of a polyester reflective material. The waist belt has a holder for radio and another holder for liquid container and the shoulder strap has a container for holding lock key and a second container for holding a defensive spray applicator.

1 Claim, 5 Drawing Sheets

SAFETY SPORT BELT

BACKGROUND OF THE INVENTION

1. Field of the Invention

This invention relates safety device, more particularly to a belt and a shoulder strap combination providing unusual abilities to provide an indication of the location of the wearer during night-time and twilight hours. For a jogger it increases the ability to indicate a presence which might not otherwise be clearly and easily apparent. The invention also provides accessories on the safety device to enable the securement of water bottles and other devices such as walkman radios and tape recorders for use of the person engaging in vigorous activity. It also allows these items to be carried comfortably, easily assessable, and without interfering with the warning capabilities of the safety belt. The belt of the present invention furthermore provides height and a waist adjustments with easy adjustment by loop belt fasteners with hook and loop securing devices to prevent the tabs from flopping about or otherwise preventing the adjustment from becoming loose. The device of the present invention is designed primarily for active sports joggers. It is also suitable for pedestrians, cyclists, crossing guard, traffic policemen, mail person, roller bladers, skate boarders, delivery person, for walking the dog or children playing in or around roadways.

2. Prior Art

Reflective warning devices have been used for some time. U.S. Pat. No. 3,089,143—JACOBSON discloses a traffic safety belt with criss-cross shoulder straps each of which is adjustable, together with an adjustable waistband portion so that one adjustment does not interfere with the other.

U.S. Pat. No 3,221,958—STRAIGHT discloses a safety belt designed for hunters and features shoulder straps that are adjustable without interfering with the adjustment of the belt which is accomplished by providing separate attaching loops and adjusting loops at the base of each shoulder strap. The shoulder straps may be pivoted about a grommet in order that a gun sling secured to the base of one shoulder strap may be easily switched from one shoulder to the other to accommodate both left and right-handed people. The structure comprises a woven mesh underlying belt which is provided with a fused reflective film on the top of it. The belt is solid and no ventilation is provided and it is a uni-color reflection. In this case the underlying web backing is preferably white to enhance the visibility of the transparent, brightly-colored reflective material which is fused over it.

U.S. Pat. No. 3,499,416—THORSHEIM also discloses a reflective safety band in the upper rows of the simple structure and features, but includes construction to provide a means of storing the device within banded loops as well as a means to adjust the length of the strap by overlapping it on itself within the securing means.

U.S. Pat. No. 5,410,762—MASKOVICH discloses an elastic strap for a jogger's compact portable device for carrying a portable radio that can be manipulated without interfering with the jogger's activity and secured against both vertical and horizontal movement from the jogger's activity. The device includes a stretchable strap having slots at each end which are less than the width of the device to be carried and results in the portable device or radio being frictionally compressed between the wearer's belt and the strap attachment. The portable device usually has a hook to fit over the belt to supply additional security. The strap ideally is made of neoprene.

One of the inherent disadvantages of prior art safety belts or warning belts and/or straps has been that for utilization that by people in jogging or engaging in other athletic activities which require a great deal of exertion is that the devices have been generally made of a plastic sheet or strip which is worn in close proximity to the wearer's torso and increased the heat of the body preventing the escape of heat and/or perspiration from the areas in which the warning strap was in contact with the body of the wearer.

In addition, those devices which provided carrying means for certain ancillary items such as radio, water, and the like were awkward to use, involved heavy enclosure-means and were difficult to reach while the wearer was engaged in the athletic activity. Adjustment means were also difficult to operate and in those cases where they were easy, the fastening means tended to become undone easily. Often the most overlooked item was provision for the exerciser to carry either house and/or vehicle keys since often the clothes worn in the activity engaged in did not provide pockets or other means for carrying small items securely and conveniently assessable.

These disadvantages of the prior art are overcome by the device of the present invention which provides an effective warning indication of the presence of the wearer, is easily adjustable, comfortable, dissipates body heat, and allows the carrying of refreshing fluids easily assessable as well as other items such as radio or portable telephone, and a handy, secure means for personal key devices.

SUMMARY OF THE INVENTION

In accordance with the present invention a safety warning belt is provided which includes a combination of warning indicators to indicate the presence of the wearer and allows the escape of built up body heat from the areas on which the belt contacts the wearer and at the same time provides means for carrying personal items such as household and vehicle keys, refreshment liquid, defensive sprays, and communication devices such as radios and tape players. The device is adjustable and the adjusting tabs are secured against undoing by a combination of hook and loop fastening strips of the type sold under the trademark VELCRO®.

The device comprises a belt and shoulder strap structure of highly visible red-orange polyester mesh of known type, however, in this case the fabric is perforated with ventilating apertures approximately 1/16" to 1/8" across, over about 60% percent of the surface of the belt and strap. Vinyl coated cotton may also be used.

The shoulder strap connects the front and the back of the belt portion of device.

Stitched along the center of the strap and belt on the outer side are vinyl-coated safety phosphorescent strips about 1 to 1½ inches wide.

The belt and strap both are generally 3 to 4 inches wide.

Also stitched to either side of the belt is a flexible device with a closure for carrying a 3 inch diameter by 7 inch long water bottle with loop and hook fastener devices forming closure means.

A carrier pouch for a radio or tape player is also provided on one side of the belt. On the forward side of the shoulder strap provision is made for attachment of a key holder pouch as well as a separate holder for a defensive spray container.

The belt is comprised of two open loops with sliding buckles or similar fasteners with the adjustable tongue straps secured upon the underlying belt by loop and hook nylon fasteners VELCRO. The same is true for the buckle on the shoulder strap. On the shoulder device a key-holder container and defensive spray container carrier are provided. Each of the ends of the shoulder strap are provided with loops that slide readily on the belt so that the shoulder strap may be adjusted for the individual build or physique of the user.

BRIEF DESCRIPTION OF THE DRAWING

In accompanying drawing which forms a part of the specification.

ILLUSTRATIVE SPECIFIC EMBODIMENT

Figure 1:
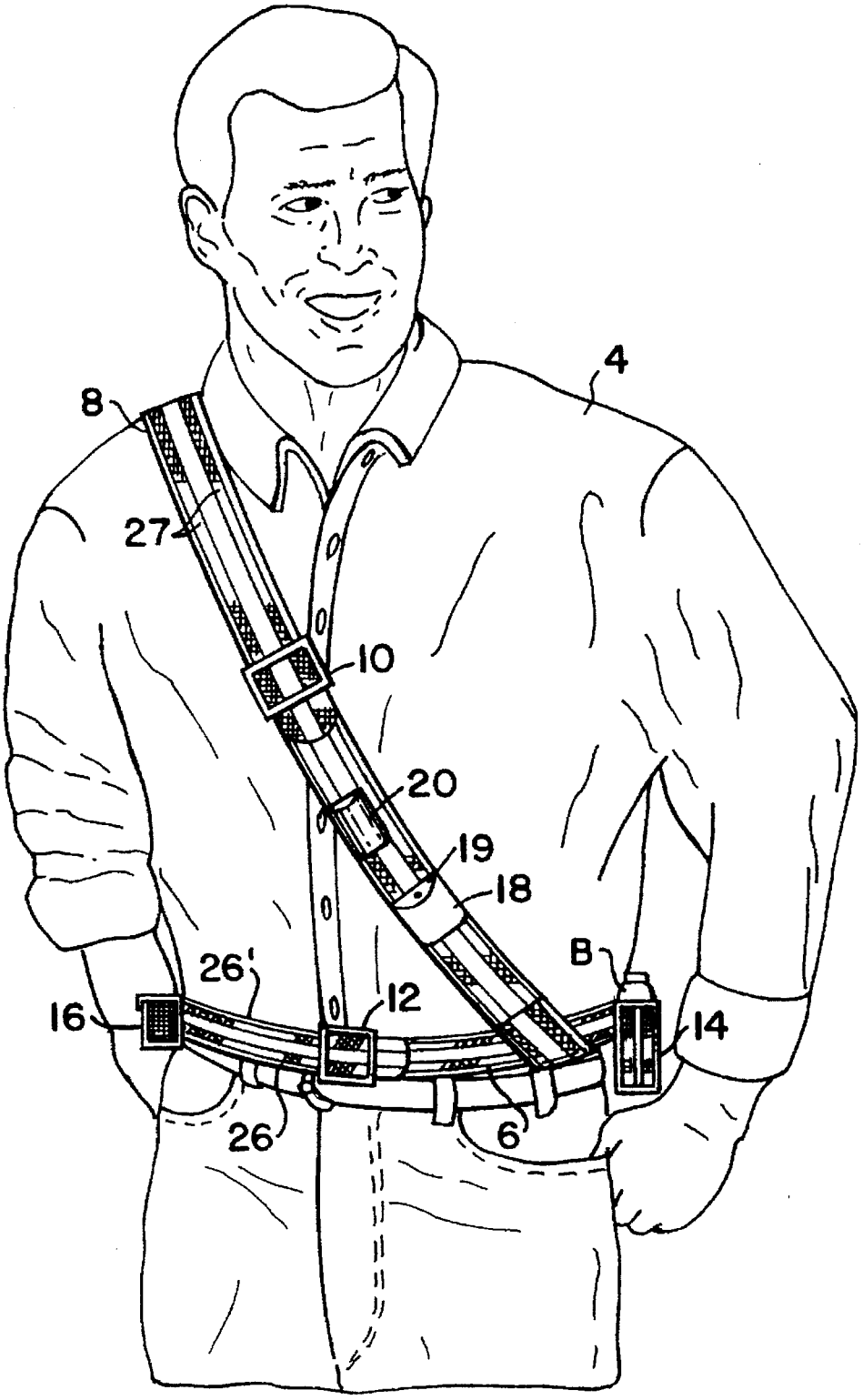
FIG. 1 is a perspective view of the device of the present invention worn by a user.

Referring to the accompanying drawing, the safety sport device 2 of the present invention is shown FIG. 1 being worn by a user 4.

The device includes a belt 6 and shoulder strap 8. An adjustable buckle 10 is provided on the shoulder strap 8 and buckle 12 on the belt 6.

A water bottle carrying container 14 is shown on the left side of the belt 6 and a container to carry a radio 16 is shown on the right side.

A key container 18 with flap cover 19 is located on the front side of the shoulder strap 8 and a pocket 20 for holding a defensive spray cylinder is also secured to the shoulder strap 8.

Figure 2:
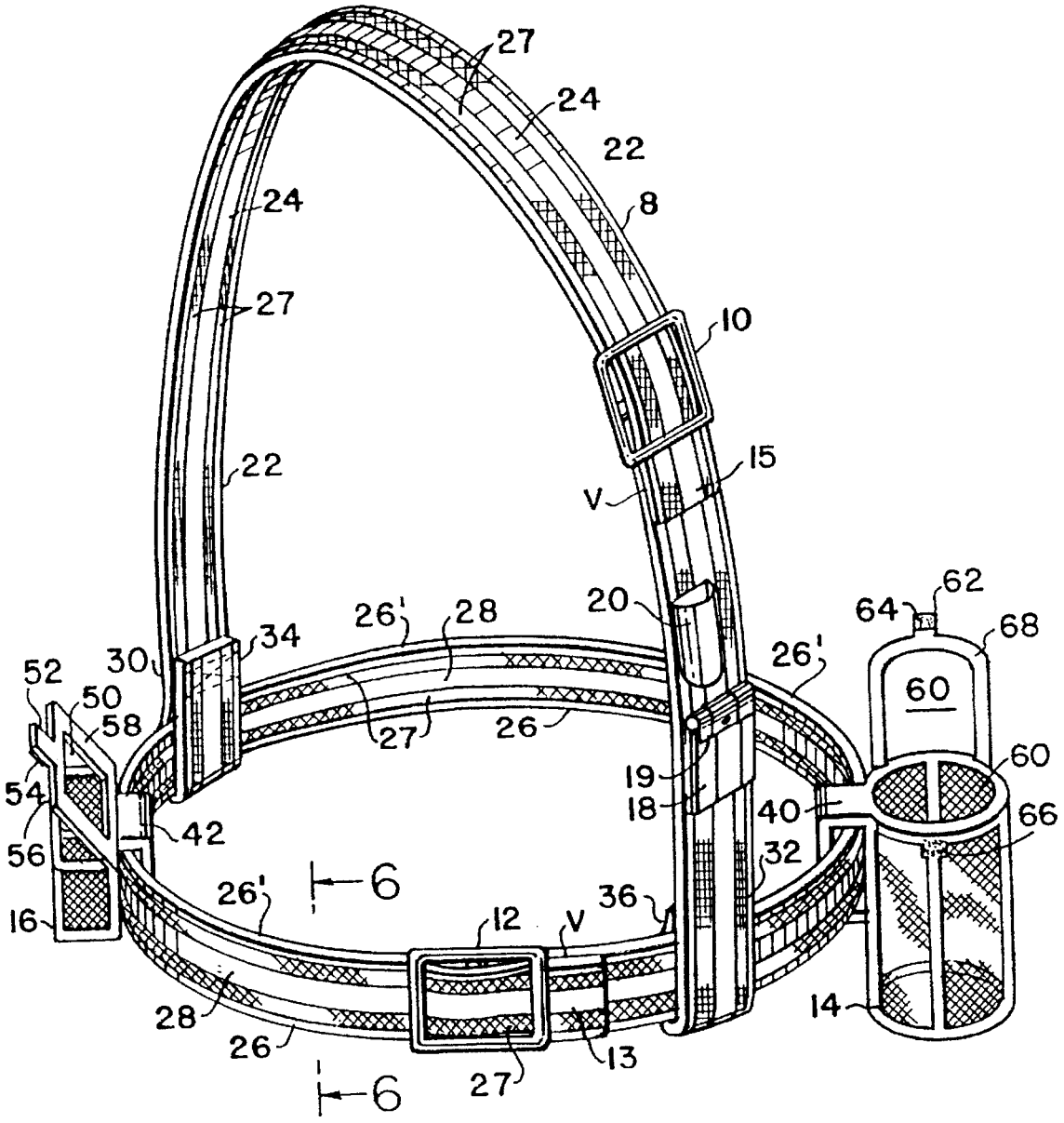
FIG. 2 is a perspective view of the device by itself.

As shown in FIGS. 2, the belt 6 is comprised of a woven underlying polyester mesh strap 26 with bright reflective orange color with apertures or gaps going all the way through the strap 8 and of approximately ⅛" diameter. Stitched along the center of both the shoulder strap 8 and belt 6 on the outer side thereof is a bright yellow strip of reflective polyester material 28 commonly sold under the trademark MYLAR®.

The lower ends 30 and 32 of the shoulder strap 8 are provided with stitched loops 34 and 36 respectively to make it easily adjustable laterally along the horizontal belt 6.

The shoulder strap 8 buckle 10 and belt 6 buckle 12 are provided with loop and hook fastening combinations (VELCRO®) V to secure the buckle flaps 13 and 15 to the underlying straps 8 and 6 to prevent unwanted unbuckling during the motion of the wearer 4.

Figure 3:
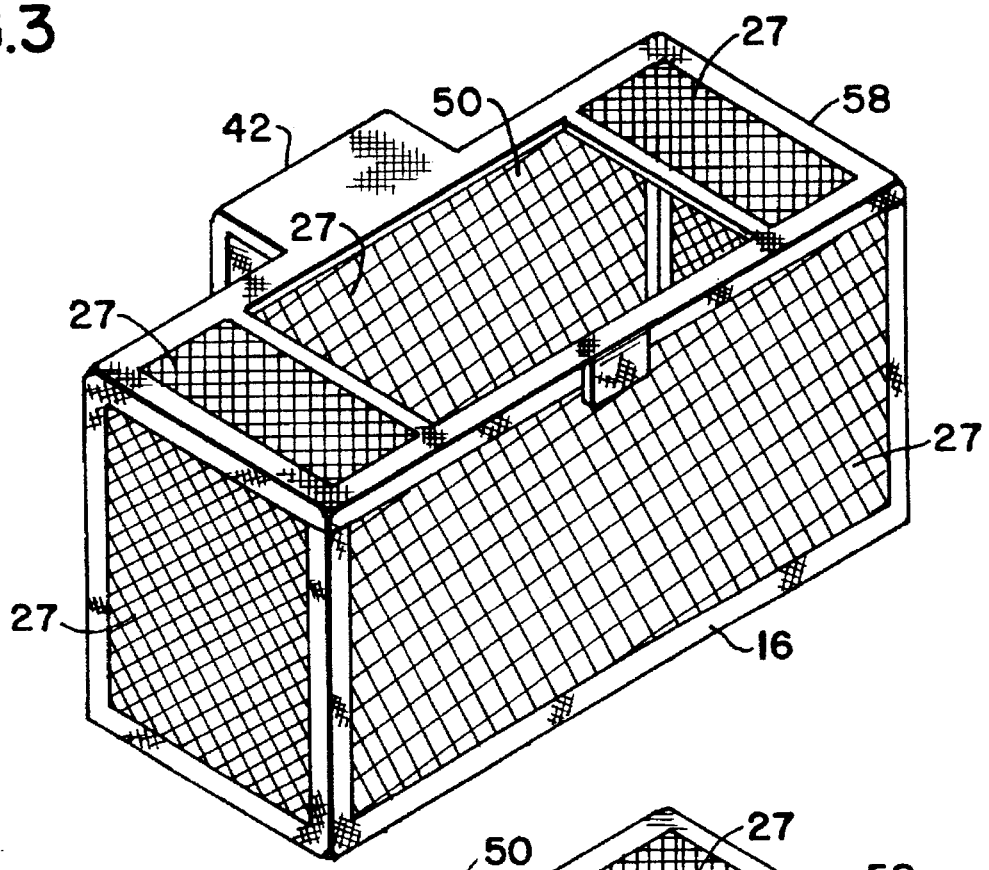
FIG. 3 is an enlarged front and side perspective view of a radio container carrier attached to the belt portion of the device.
Figure 4:
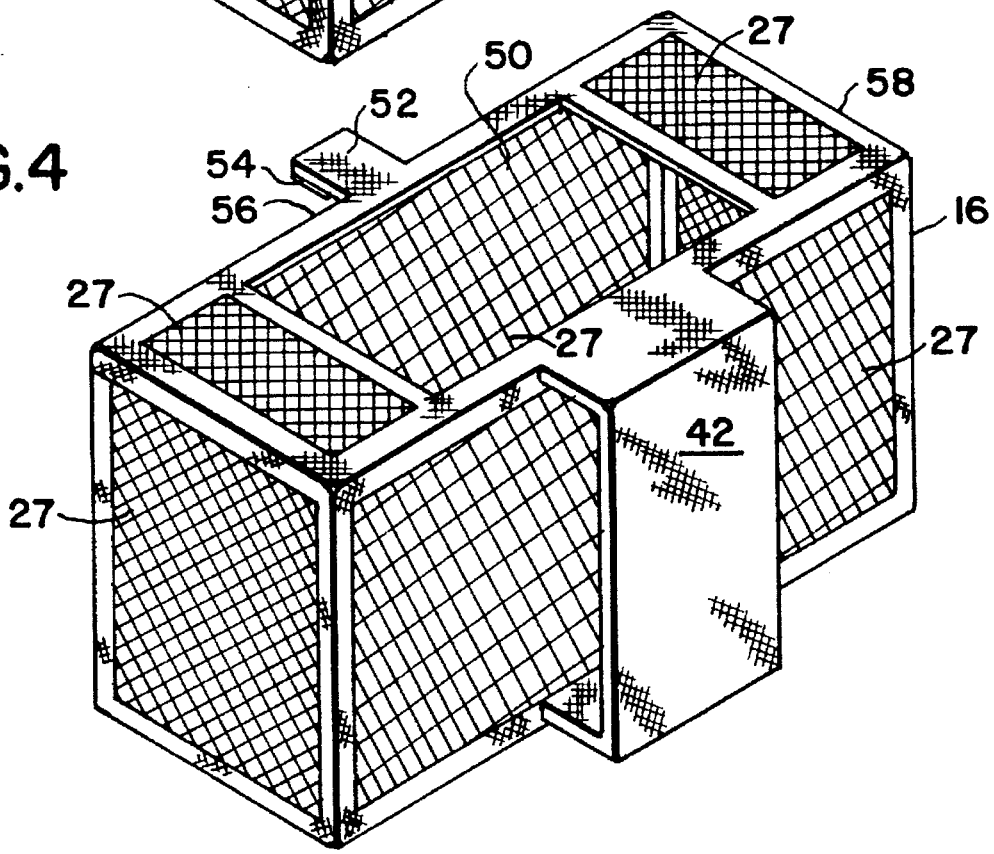
FIG. 4 is a rear side perspective view of the same container as shown in FIG. 3.

The holder 16 for a radio or recorder as shown in greater detail in FIGS. 3 and 4 includes a loop or strap 42 for securing to the belt 6. Made of a polyester, the frame 58 of the holder 16 is generally of rectangular form with a flap cover 56 and a central opening 50 for easy access to the controls of the radio or tape player. The walls and panels are also made of the red vinyl covered polyester or cotton mesh 27. The closure 52 has VELCRO strips 54 for securing. The container 16 is flexible so that it tends to lay flat if not filled with the radio or a tape player.

Figure 7:
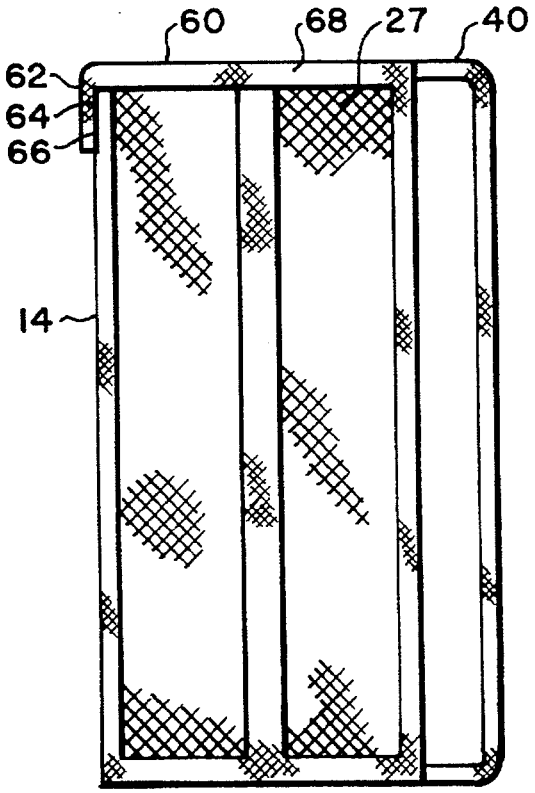
FIG. 7 is a side elevational view of the device of the water carrier container.
Figure 8:
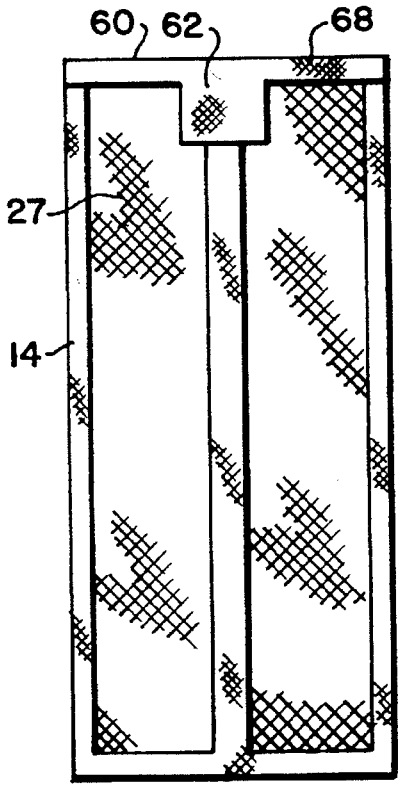
FIG. 8 is an end elevational view thereof.

The water container holder 14 shown in FIGS. 7 and 8 is of similar construction with the plastic framework 68 and the loop 40 for securing to the belt 6. The top 60 is closed with tab 60 and VELCRO pads 64 and 66.

Figure 5:
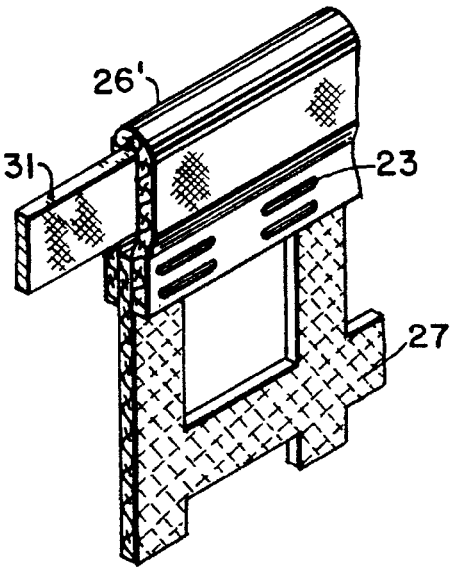
FIG. 5 is a large sectional view of the portion of the belt showing the details of the mesh material.

An enlarged perspective view of the belt 6 structure in FIG. 5 shows the mesh 27 is bound with stitching 23 at the side with black fabric band $26^1$ and a plastic stiffener 31 to prevent the belt 6 rolling over on itself.

Figure 6:
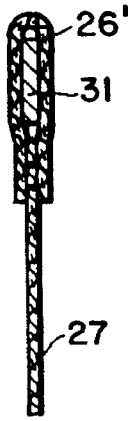
FIG. 6 is a sectional view of the material taken along lines 6—6 of FIG. 2 and shown in perspective in FIG. 5.
Figure 9:
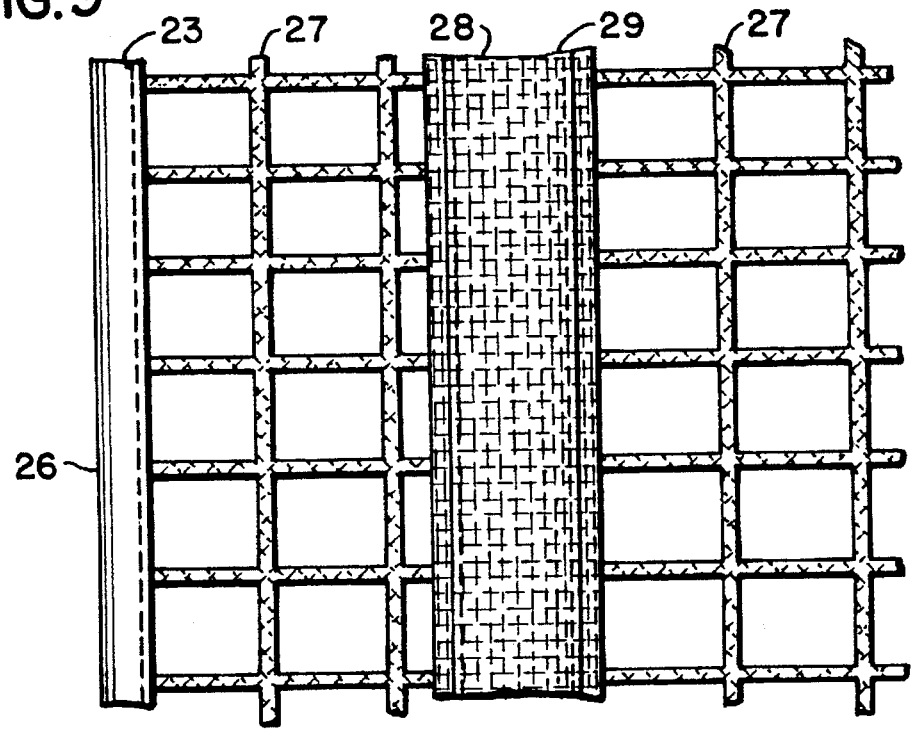
FIG. 9 is an enlargement of the details of the stripping.

The belt straps 6 as shown in FIG. 9 has the vinyl-covered mesh 27 over which is stitched a reflective strip 29 which is stitched to the transparent yellow strip 28. The border 26 is stitched with stiffener 31 as shown in greater detail in FIGS. 5 and 6.

Figure 10:
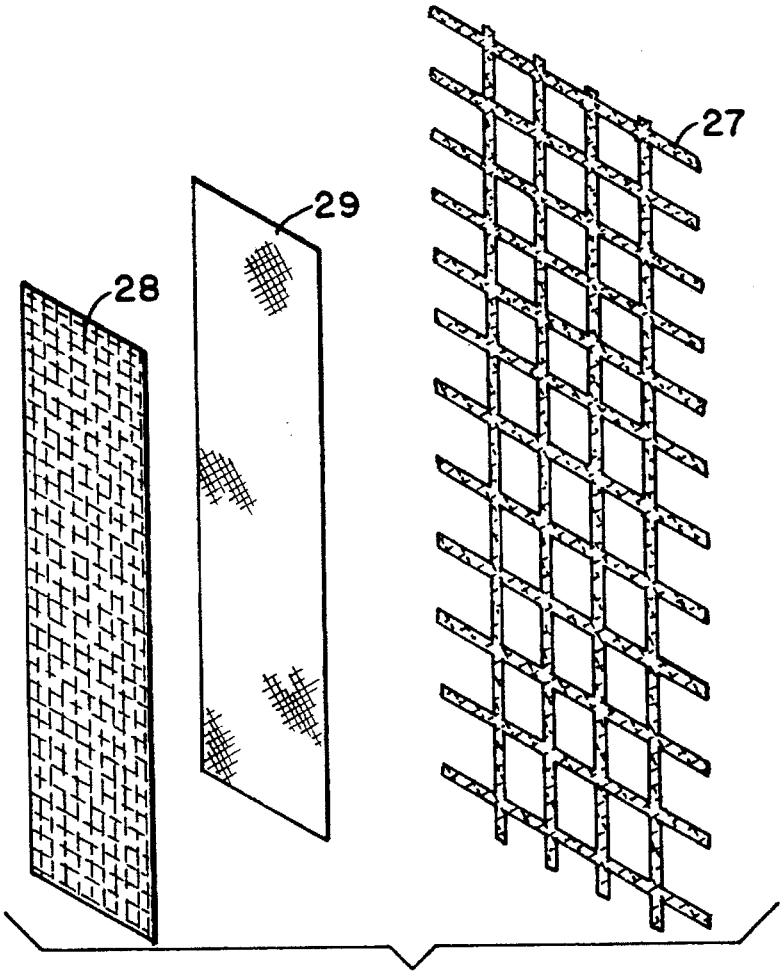
FIG. 10 is a sectional view of the details of the stripping.

FIG. 10 shows the transparent yellow strip 28 backed by the reflective white polyester 29 and the red polyester mesh 27.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A safety sport belt comprising a wide waist belt portion having buckling means, at least one shoulder strap having opposite ends slidingly and laterally connected at each said end thereof to said belt portion, said belt portion and strap each comprised of a polyester mesh fabric coated with red reflective material, side edges of said mesh fabric being stitched with a border stiffening material and edging fabric to inhibit unraveling, a transparent yellow/green strip centrally and axially aligned on outer surfaces of said strap and belt portions, said strip stitched over a non-transparent strip of a bright white polyester reflective material which is secured centrally longitudinally on said strap and said belt portions, said belt portion having ends securable to each other, a holder for a radio and a holder for a liquid container mounted on said belt, said holders being flexible, said strap having a front portion, adaptable to face a user's chest, said front portion of said strap having secured thereto a container suitable for carrying a lock key and a second container suitable for carrying a defensive spray applicator.

* * * * *